United States Patent [19]

Damron et al.

[11] 4,199,193

[45] Apr. 22, 1980

[54] UNDERGROUND MINING MACHINE HAVING TEMPORARY ROOF SUPPORT MEANS AND ROOF BOLTING MEANS ASSOCIATED THEREWITH

[75] Inventors: Earl M. Damron, Huntington; Jack I. Lipps, Williamson, both of W. Va.

[73] Assignee: Acme Machinery Company, Huntington, W. Va.

[21] Appl. No.: 928,853

[22] Filed: Jul. 28, 1978

[51] Int. Cl.[2] ..... E21C 29/02

[52] U.S. Cl. ..... 299/31; 299/11; 299/33

[58] Field of Search ..... 299/31-33, 299/11

[56] References Cited

U.S. PATENT DOCUMENTS

| | | | |
|---|---|---|---|
| 2,916,274 | 12/1959 | Haworth et al. | 299/31 |
| 3,169,796 | 2/1965 | Long et al. | 299/31 |
| 3,314,723 | 4/1967 | Mennekes | 299/43 |
| 3,363,945 | 1/1968 | McLaughlin et al. | 299/31 |
| 3,677,603 | 7/1972 | Small | 299/31 |
| 3,995,905 | 12/1976 | Jamison | 299/11 |
| 4,131,317 | 12/1978 | Jamison et al. | 299/31 |

OTHER PUBLICATIONS

"New Techniques on Short Wall Faces and Headings", by F. Small, Mining Tech., Apr. 1971, pp. 7-16.

*Primary Examiner*—Ernest R. Purser
*Attorney, Agent, or Firm*—Robert D. Yeager

[57] ABSTRACT

The mining machine consists of a main frame having a front portion and a rearwardly extending portion, and cutter heads disposed for movement across the front portion for dislodging mineral. A conveyor system is provided which extends across of the front of the main frame and along the rearwardly extending portion thereof for carrying dislodge mineral from the mine face. Forward roof support jacks, which are attached to the main frame for unitary movement therewith, provide temporary roof support as the entry is being formed. Rear roof support jacks, disposed behind the forward roof support jacks, also provide temporary roof support. Sumping cylinders, which are disposed generally parallel to the mine floor, connect the rear roof support jacks to the main frame and are used for moving the mining machine. The sumping cylinders are connected to the main frame with a universal joint connection to permit free movement of each sumping cylinder around its point of connection to the main frame. Steering cylinders, for positioning the sumping cylinders, are connected between each sumping cylinder and the main frame. Pivot jacks are provided on the main frame that extend to provide a pivot point around which the main frame can be moved by extending the sumping cylinders. The mining machine includes roof bolters, attached to the rear roof supports, for installing a series of roof bolts as the machine advances. Rib cleaners are provided for cleaning the mine ribs as the machine forms the entry.

16 Claims, 10 Drawing Figures

UNDERGROUND MINING MACHINE HAVING TEMPORARY ROOF SUPPORT MEANS AND ROOF BOLTING MEANS ASSOCIATED THEREWITH

BACKGROUND OF THE INVENTION

1. Field of the Invention

This invention relates to underground mining and more particularly to a mining machine for forming an entry in a multi-entry mine.

2. Description of the Prior Art

Longwall mining is becoming the preferred method of removing coal from a deep underground mine. Generally, longwall mining is a system for removing coal from an extended face of coal, say several hundred feet in length, as opposed to removing coal from a face that is essentially the width of a continuous mining machine.

The formation of entries in a multi-entry mine where longwall mining is carried out presents a problem in that the longwall mining apparatus can remove coal faster than the required entries can be formed. The known entry forming machines use separate pieces of machinery for removing coal from the entries and for providing the necessary roof support. For example, a continuous mining machine typically is used to drive an entry until the established limits of unsupported roof above it are reached; the mining machine is backed away from the entry face and moved to another entry for further driving while a roof bolter is moved into the entry vacated by the mining machine to install the required roof bolts. This procedure requires a large number of equipment moves and thus presents a hazard to personnel in the coal mine because the rate of equipment movement must be relatively rapid to optimize efficiency.

Furthermore, the requirement of rapid movement by separate items of equipment renders impractical the use of a mining machine for each entry, not only because of the expense involved but also because of the equipment congestion that would ensue. In addition, a conventional continuous mining machine, which is usually self-propelled on threads or the like, cannot easily be turned 90° within a mine entry to form the necessary cross-cuts in a multi-entry mine system. Accordingly, in the typical multi-entry mine, only one mining machine is employed to drive say three entries; this means that the mining machine spends a considerable amount of time in transiting between entries and spends relatively little time at the entry faces removing mineral.

SUMMARY OF THE INVENTION

The present invention provides apparatus for forming an entry in a multi-entry mine. Ideally, one of the machines of the invention is assigned to each of the parallel entries and that machine remains in operation in that entry until the entire entry is formed. The machine also forms connecting cross-cuts between the parallel entries being formed. The mining machine in the entry into which the cross-cut is to be formed places a series of roof bolts next to the mine rib through which the adjacent entry forming machine will break. This limits the distance that the entry driver forming the cross-cut must travel into the parallel entry to install required roof bolts.

The mining machine of the present invention comprises: a main frame having a rearwardly extending portion; auger heads movable across the front of the main frame for dislodging mineral from a mine face; a conveyor for moving the dislodged mineral from the mine face; a plurality of forward temporary roof support jacks for providing temporary roof support as the mine face is advanced; roof bolters connected for movement with the machine for installing roof bolts as the mine entry is formed; a plurality of rear temporary roof support jacks for providing temporary roof support; sumping cylinders operable in conjunction with the rear roof support jacks for moving the machine within the mine; and steering means for steering the machine in the mine to form cross-cuts.

The machine of the present invention preferably is powered from a hydraulic power pack which trails at a distance behind the mining machine. An air supply is provided to the mine face for the liberation of methane gas and/or particulates, such as coal dust.

The main frame of the machine can be of a "T" shape with the head of the T disposed at the mine face and the leg (or stem) extending rearwardly. A pair of mining augers, which dislodge mineral from the mine face, are provided for movement back and forth across the head of the T-shaped main frame; progressive dislogment of mineral forms the desired mine entry. A conveyor system is provided which extends along the head and the leg of the T-shaped frame to convey dislodged mineral away from the mine face.

A plurality of temporary roof support jacks are provided at the head of the main frame and are connected securely thereto. The jacks are connected for movement with the main frame as a unit. Each of these jacks is hydraulically operable between a retracted position and an extended position to simultaneously engage the roof and floor of the mine for providing temporary roof support. Caps are provided on the tops of the roof support jacks for covering a larger area of the mine roof.

A pair of rear roof support jacks are provided behind the forward roof support jacks. Each of these rear roof jacks likewise is hydraulically operable between a retracted position and an extended position to simultaneously engage the roof and floor of the mine and thereby provide temporary roof support. Caps also are provided on the tops of the rear roof support jacks for covering a larger area of the mine roof.

Each of the rear roof jacks is connected to the main frame by a hydraulically operated sumping cylinder. Each of the sumping cylinders is independently operable between an extended position and a retracted position for changing the position of the associated rear roof jack relative to the main frame. The sumping cylinders are connected to the main frame by a universal type joint to permit each sumping cylinder to be moved freely about its point of connection to the main frame.

A pair of steering cylinders are connected between each sumping cylinder and the main frame for independently moving each sumping cylinder about its point of connection to the main frame. The steering cylinders are provided with universal connections at both ends to permit free movement of the sumping cylinders.

A pair of pivot cylinders are provided at spaced locations in the head of the T-shaped main frame. The pivot cylinders permit the main frame to be moved about one or the other of them by selective positioning and actuation of the sumping cylinders. Each pivot cylinder is movable between a retracted position out of engagement with the mine floor and an extended position in engagement with the mine floor, partially supporting the mining machine. With the mining machine so supported on one pivot cylinder, the appropriate sumping cylinder can be swung out of alignment with the leg of the main frame to move the main frame about the pivot cylinder. This movement is begun with the appropriate steering cylinder extending its associated sumping cylinder until it is at an angle of approximately 25° with the leg of the main frame. When the sumping cylinder is swung out and is actuated to its extended position, it moves the main frame around the pivot cylinder, which is engaging the mine floor, and pushes the main frame through an angular movement of approximately 25°. With four such movements, the main frame can be moved through 90° from a position facing the mine entry face to a position facing the mine rib (or wall); the machine is thus positioned to form a cross-cut to an adjacent mine entry. During the turning operation, the rear roof support jacks can also be swung into proximity with their adjacent mine ribs for selectively installing roof bolts along the mine rib.

The roof bolters just mentioned are mounted to the rear temporary roof support cylinders for movement therearound. The roof bolters are used for installing the required pattern of bolts in the mine roof, generally on four foot centers, both in the entries and in the cross-cuts.

The augers provided on the front of the mining machine of the present invention are sumped into the mine face to a depth approximately equal to their length. The sumping cylinders in turn are provided with a stroke equal to about twice that depth of cut. Thus, when the rear roof support cylinders are in place with the sumping cylinders retracted, the machine of the present invention can be advanced in two steps to extend the mine entry. When the augers are sumping into the mine face, the rear roof support cylinders are fixed and fully extended. This allows roof bolting to be conducted while augers are activated.

The T-shaped main frame of the machine of the present invention has a leg which is shorter than the width of the mine entry so that the main frame easily can be turned in the mine entry. With the sumping cylinders retracted, the rear roof support jacks do not extend beyond the end of the leg of the T-shaped main frame.

Rib cleaners are provided on the ends of the T-shaped main frame. The rib cleaners are urged outwardly by hydraulic cylinders and a gas-charged accumulator to provide for constant contact of the rib cleaners with the mine ribs. As the machine advances, the rib cleaners channel loose mineral onto the main frame conveyor.

The mining machine of the present invention permits the driving of mine entries without the need to retract the machine from the mine face except for driving cross-cuts. This advantageous method of mining is facilitated by the temporary roof support means associated with the machine and the roof bolting mechanisms that advance with the machine. Exceptional advantages accrue in the use of the invention by reason of the machine's capability of turning within the mine entry to form cross-cuts. The installation of permanent roof supports in the required pattern, while mining operations and machine-turning operations are being carried out, affords even further advantages in terms of personnel safety and mining efficiency.

BRIEF DESCRIPTION OF THE DRAWINGS

Reference may be had to the preferred embodiment exemplary of the present invention as shown in the accompanying drawings in which.

DETAILED DESCRIPTION OF THE PREFERRED EMBODIMENTS

Figure 1:
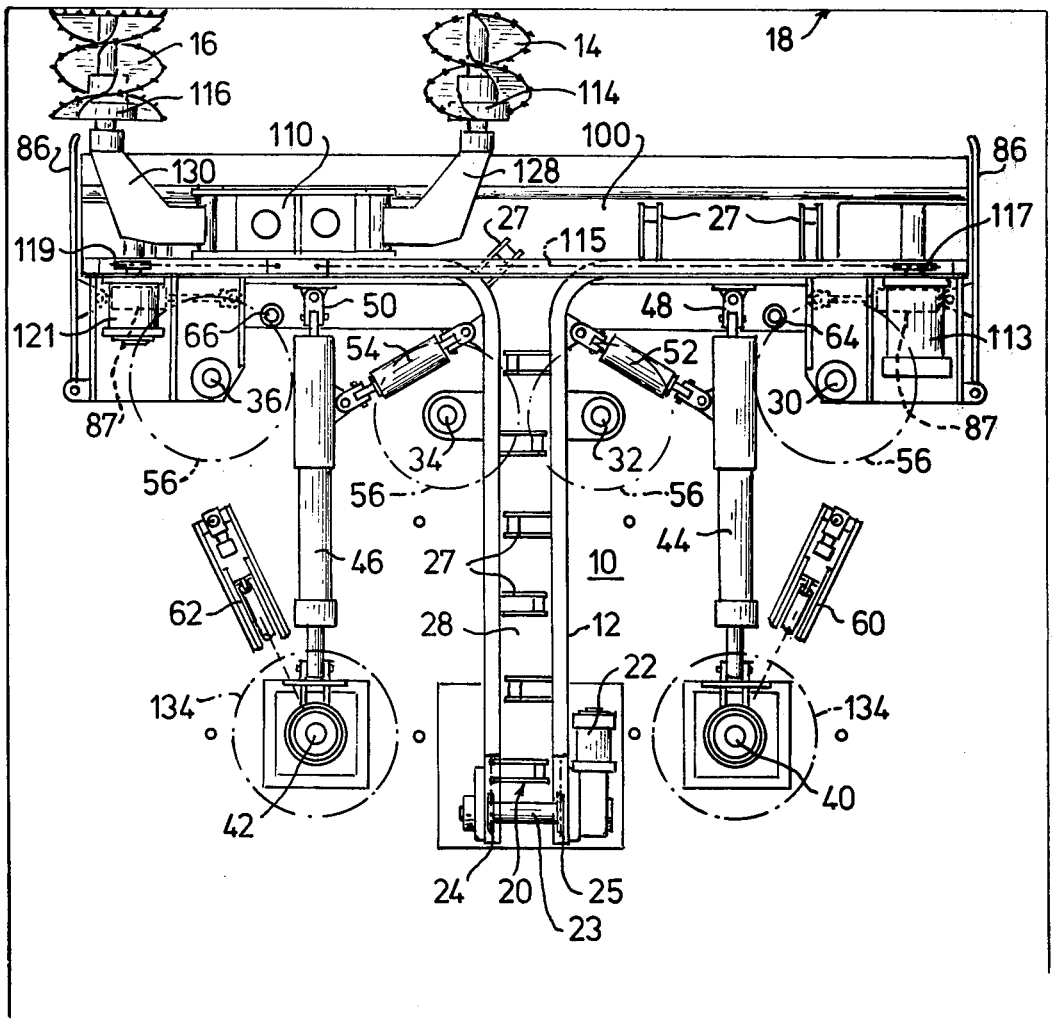
FIG. 1 is a plan view of a mine entry driving machine embodying the present invention.
Figure 2:
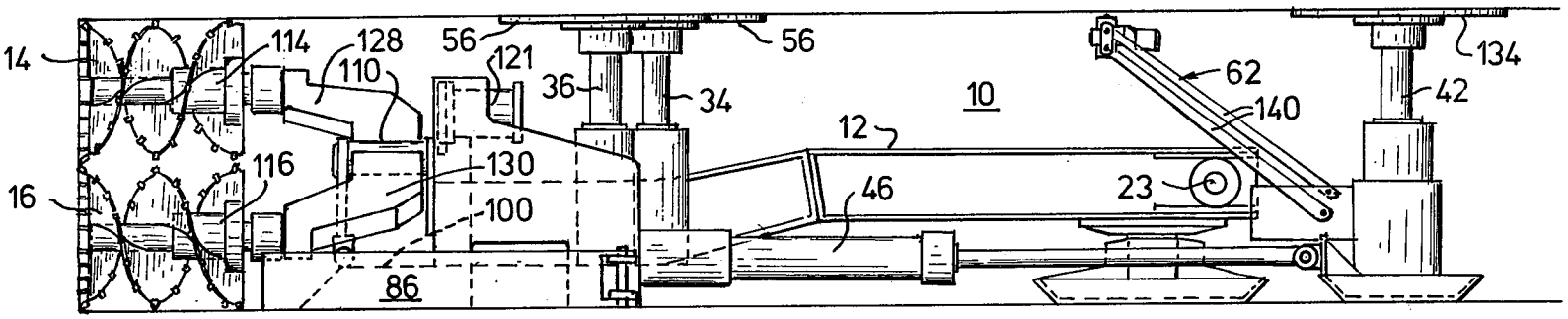
FIG. 2 is a side elevation view of the entry driver of FIG. 1 with a sumping cylinder in the fully extended position.
Figure 3:
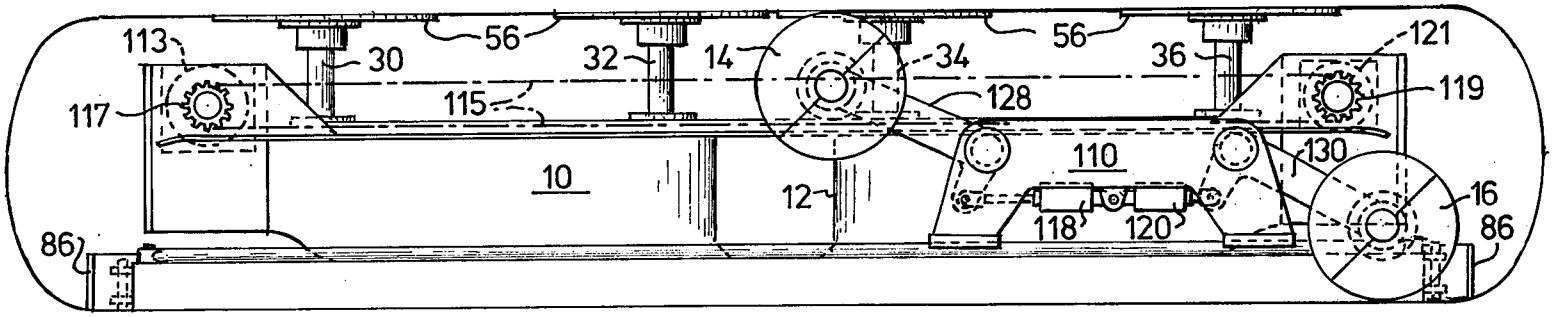
FIG. 3 is a front view of the entry driver shown in FIG. 2.

Referring now to the drawings there is shown a mining machine (or mine entry driver) 10 embodying the present invention. Mining machine 10 is formed with a main frame 12 having a T-shape. The length of the rearwardly extending portion (or leg) 28 of the T-shaped main frame 12 is less than the length of the cross member. A pair of hydraulically driven augers 14 and 16 are mounted on the front of main frame 12. Augers 14 and 16 are moved back and forth across the front of the T-shaped main frame 12 to cut mineral from the mine face which is generally designated by the numeral 18. A discharge conveyor 20 extends across the front of the main frame 12 and down the leg 28 to carry dislodged mineral away from the mine face 18. Conveyor 20 is driven by a single drive unit 22, and is constructed to transport mineral from the mine face to a conveyor system 80 (see FIG. 7) which moves mineral out of the mine.

Machine 10 includes four forward roof support jacks 30, 32, 34 and 36 which are connected to main frame 12 for unitary movement with it. Forward roof support jacks 30, 32, 34 and 36 are hydraulic cylinders which are extended to engage both the mine roof and floor to provide temporary roof support. Forward roof support jacks 30, 32, 34 and 36 have caps 56 mounted at their upper ends to extend the area of roof supported by these jacks.

Temporary roof support also is provided by a pair of rear roof support jacks 40 and 42. Rear roof support jacks 40 and 42 likewise are hydraulic cylinders which extend to engage the mine floor and roof and which have caps 134 to extend the area of supported roof. Rear roof support jacks 40 and 42 are connected to the main frame 12 of mining machine 10 by sumping cylinders 44 and 46, respectively.

Sumping cylinders 44 and 46 are hydraulically operated cylinders having a four foot stroke. The cylinders 44 and 46 are connected to the main frame 12 by universal joint connections 48 and 50, respectively. This permits the sumping cylinders 44 and 46 to move freely about their points of attachment to the main frame 12. Sumping cylinders 44 and 46 are connected to the rear roof support cylinders 40 and 42, respectively, by pivot pin connections. This mode of attachment of sumping cylinders 44 and 46 allows for uneven floor conditions that are certain to exist in an underground mine.

A pair of steering cylinders 52 and 54 are connected between sumping cylinders 44 and 46, respectively, and the main frame 12. Steering cylinders 52 and 54 are used to position their associated sumping cylinders 44 and 46 at a desired angle with respect to the main frame 12.

Roof bolters 60 and 62, described in greater detail hereinafter, are supported from rear roof support jacks 40 and 42, respectively. Roof bolters 60 and 62 are mounted for pivotal movement around their associated rear roof support jacks 40 and 42 in a manner that permits each roof bolting assembly to swing freely across its associated sumping cylinder to perform work either inboard or outboard of the sumping cylinder. Roof bolters 60 and 62 are used for installing bolts in the mine roof to provide permanent roof support; such procedure is a well known and accepted technique for protecting mine personnel and equipment against cave-ins.

Mining machine 10 also includes pivot (or turning) cylinders 64 and 66 which are mounted vertically in main frame 12 at locations outboard of universal joint connections 48 and 50, respectively. Pivot cylinders 64 and 66 each are operable between an extended position in engagement with the mine floor and a retracted position out of engagement therewith. When one of pivot cylinders 64 or 66 is actuated to the extended position, it engages the mine floor to slightly raise mining machine 10 above the floor at that point and thus partially support the machine's weight. Accordingly, pivot cylinder 64 or 66 alternately can provide a pivot axis about which mining machine 10 may be turned. The turning sequence will be described hereinafter.

The general operation of mining machine 10 will now be described; as this description proceeds, other features of the machine will be elaborated upon. Mining machine 10 is used to drive an entry by first positioning it with the cross member of the T-shaped main frame 12 generally parallel to mine face 18 and the tips of augers 14 and 16 closely adjacent thereto (see FIG. 1). Sumping cylinders 44 and 46 are positioned parallel to leg 28 of main frame 12 and rear roof support jacks 40 and 42 are extended to engage the mine floor and roof. These jacks thus provide anchor points for the forward movement of machine 10 that will ensue. Forward roof support jacks 30, 32, 34 and 36 are placed in the retracted position and sumping cylinders 44 and 46 are activated to thrust main frame 12 forward into mine face 18. As this forward movement occurs, augers 14 and 16 are placed in operation to bore into mine face 18 a distance equal to their length; in the preferred embodiment, this distance is two feet. After sumping cylinders 44 and 46 are extended two feet, the operator stops their operation at a position which is then equal to about one half of their total stroke. The operator activates front roof support jacks 30, 32, 34 and 36 to provide temporary roof support and commences to move augers 14 and 16 across mine face 18 to remove a section of mineral two feet in depth.

While the mineral at mine face 18 is being dislodged, the roof bolter operators install bolts in the mine roof in accordance with prescribed specifications, using roof bolters 60 and 62 which are identical in construction. Roof bolter 62 (see FIG. 8) is a commercially available device which is modified only to permit its use with the mining machine of the present invention. Roof bolter 62 is mounted for pivotal movement about rear roof support jack 42 in a manner that permits roof bolter 62 to swing from side-to-side across its associated sumping cylinder 46. Through the use of hydraulic cylinders and mechanical linkages including a pair of support arms 140, drill head 142 is supported for vertical and swinging movement to position it at desired locations adjacent the mine roof. During drilling and roof bolt insertion, which are carried out by well-known techniques, hydraulically actuated floor support 144 engages the mine floor to provide rigid support for the roof bolting assembly.

The operation of roof bolter 62 involves the insertion of a drill rod into drill chuck 148 and the drilling of a hole in the mine roof. The drill rod is retracted and removed from drill chuck 148 and a standard roof bolt substituted therefor. Drill chuck 148 again is actuated and the roof bolt is forced into the drilled hole in the mine roof. The roof bolt provides permanent roof support.

Figure 8:
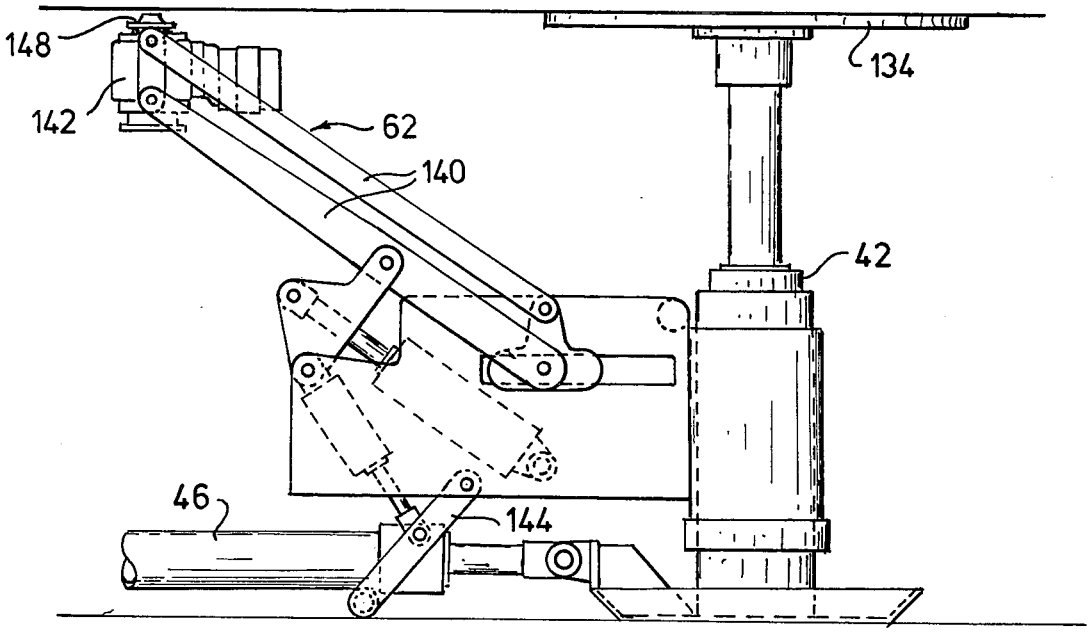
FIG. 8 is an enlarged side elevation view of a roof bolter suitable for use with the machine of the present invention.
Figure 10:
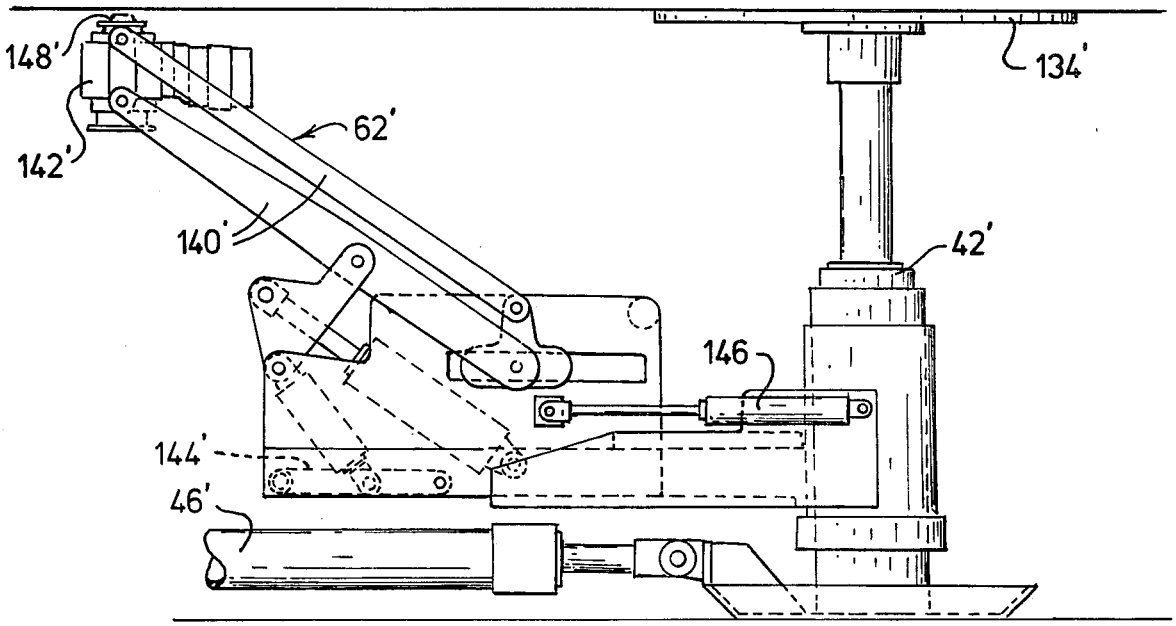
FIG. 10 is an enlarged view similar to FIG. 8 of another embodiment of a roof bolter for use with the machine of the present invention.

The roof bolter 62' shown in FIG. 10 is an alternate embodiment of the bolter of FIG. 8 with like parts being identified by like reference numerals with superscripts. The roof bolter of FIG. 10 is not confined to movement only in an arcuate path around rear roof jack 42' but may be moved radially back and forth with respect to rear roof support jack 42' by means of a pair of horizontally-extended cylinders 146 (only one of which is shown).

When roof bolts have been installed in the roof areas inboard of sumping cylinders 44 and 46, i.e. in the areas between sumping cylinders 44 and 46, respectively, and leg 28 of main frame 12, roof bolters 60 and 62 are swung across their respective associated sumping cylinders 44 and 46 to install roof bolts in the roof areas outboard of those cylinders. Then when these roof bolts have been installed and augers 14 and 16 have completed dislodgement of a two foot deep section of mineral at mine face 18, forward roof support jacks 30, 32, 34 and 36 are retracted and sumping cylinders 44 and 46 again are activated to the limit of their stroke (about four feet) to thrust main frame 12 into mine face 18 another two feet. Forward roof support jacks 30, 32, 34 and 36 are extended to provide temporary roof support and the roof bolting operation just described is repeated. When the second two foot deep section of mineral is dislodged from mine face 18 and roof bolts have been installed on both sides of each of sumping cylinders 44 and 46, rear roof support jacks 40 and 42 are retracted and sumping cylinders 44 and 46 are retracted to move rear roof support jacks forward a distance of about four feet. Since the roof bolter operators generally will be stationed in the areas between leg 28 of main frame 12 and sumping cylinders 44 and 46, respectively, it is desirable from the safety standpoint that roof bolters 60 and 62 be positioned outboard of their associated sumping cylinders when the forward movement of rear roof jacks 40 and 42 takes place. The foregoing concludes one complete entry driving cycle of mining machine 10; this cycle is repeated as long as forward entry driving is desired.

During the operation of mining machine 10 as described above, caps 56 on the forward roof support jacks and caps 134 on the rear roof support jacks provide substantial protection for personnel operating the machine. In the present embodiment, caps 56 are dimensioned so that with sumping cylinders 44 and 46 in their fully extended position, roof bolters 60 and 62 operate at a distance no greater than five feet from the temporary roof support offered by caps 56. This feature permits the machine of the present invention to comport with existing regulations in the coal mining industry.

Figure 4:
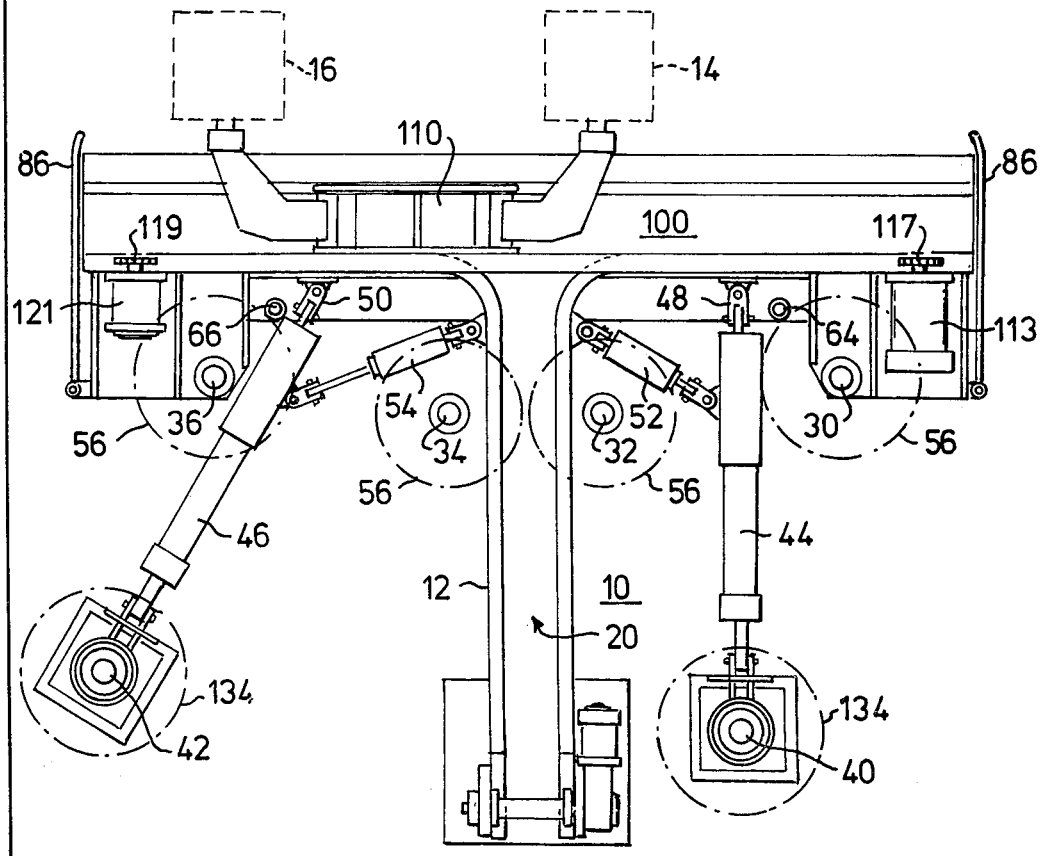
FIG. 4 is a top plan view of the entry driver of the present invention with the left sumping cylinder swung out of parallel alignment with the rearwardly extending portion of the main frame.
Figure 5:
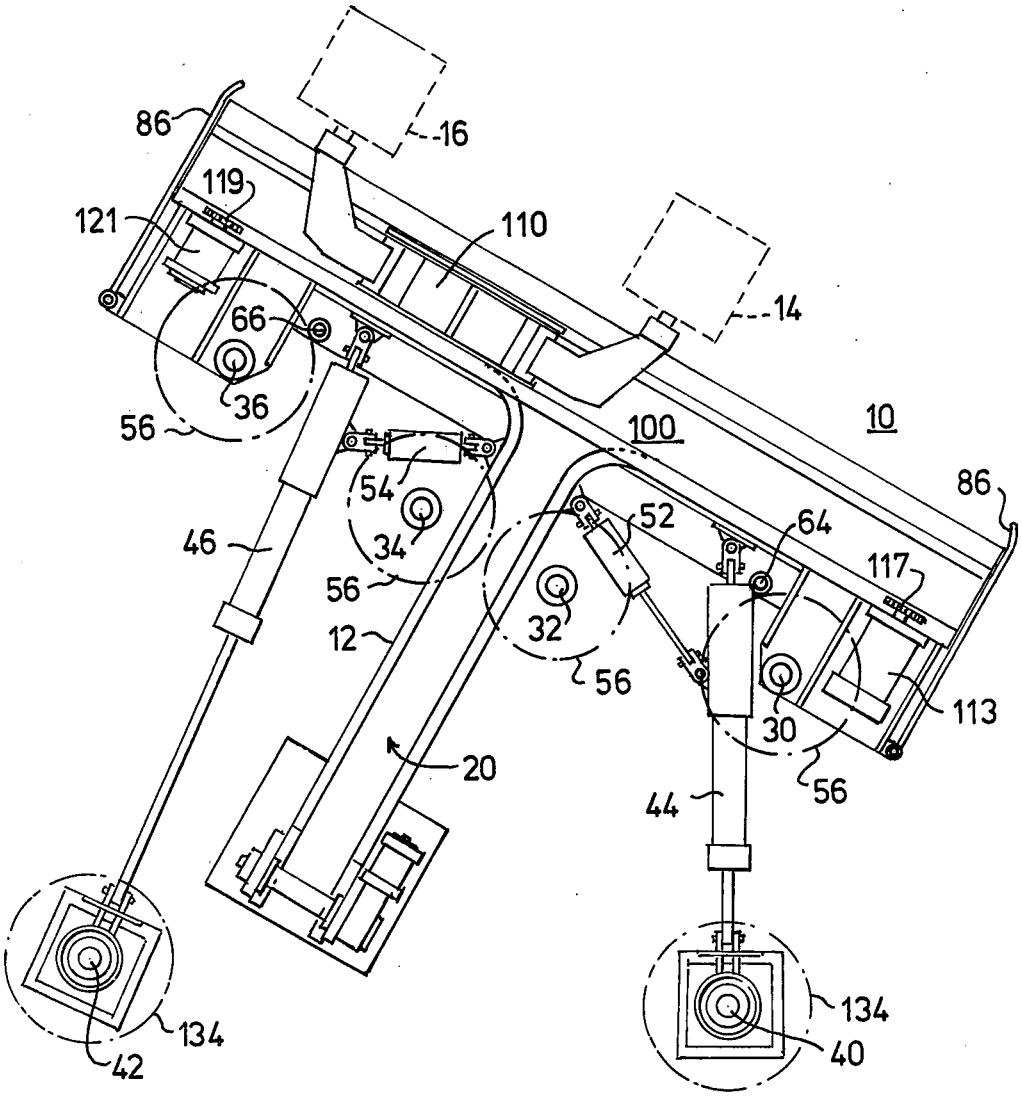
FIG. 5 is a top plan view similar to FIG. 4 showing the left sumping cylinder extended to rotate the entry driving machine about the right pivot cylinder.
Figure 6:
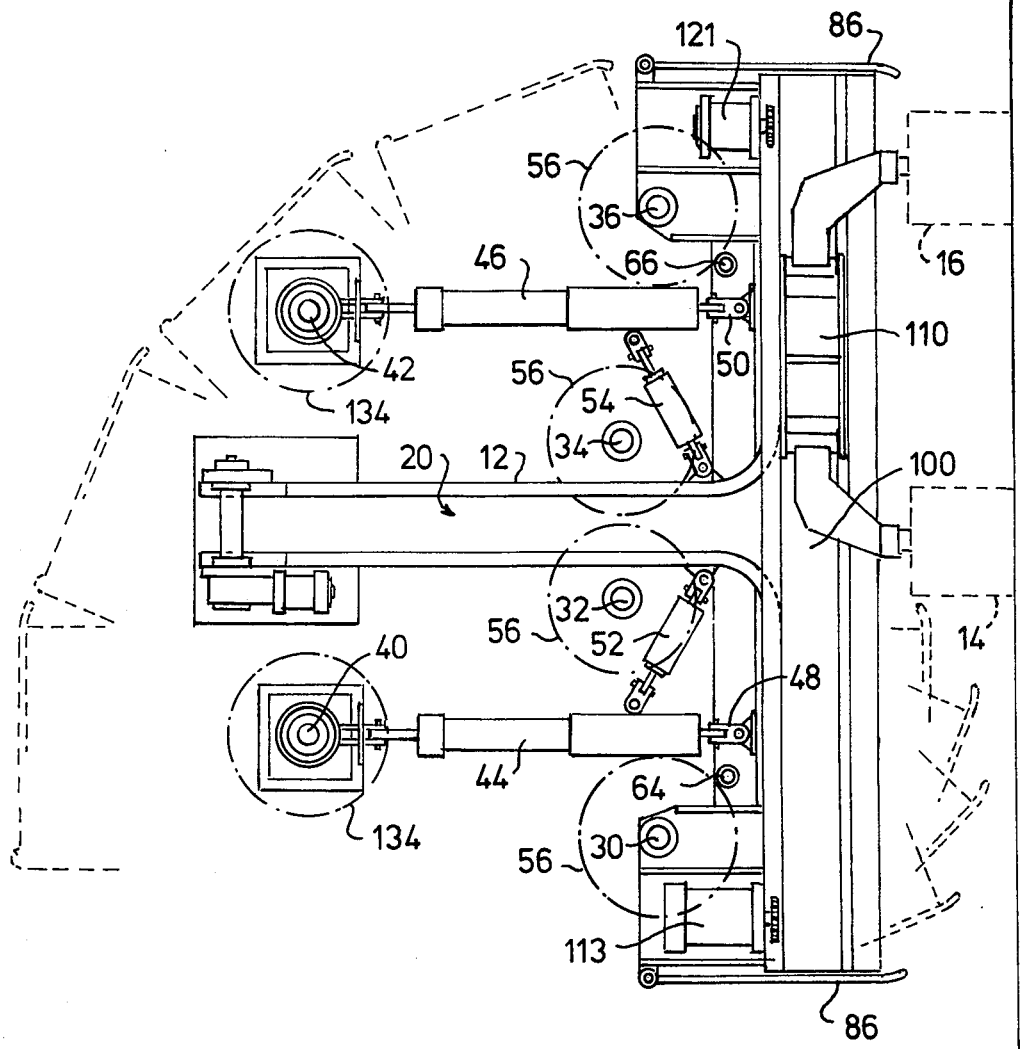
FIG. 6 is a top plan view similar to FIGS. 4 and 5 showing the entry driver perpendicular in the mine entry to face a rib (wall) for making a cross-cut; the dashed lines illustrate the sequence of positions that may be assumed by the main frame of the machine as it is turned 90° in the mine entry.

As alluded to above, mining machine 10 is constructed to permit its being turned in the mine entry. This turning capability, made possible by the fact that leg 28 of main frame 12 is shorter than the length of the cross member of the T-shaped main frame 12, allows mining machine 10 to form cross-cuts between adjacent mine entries. The turning sequence is best illustrated in FIGS. 4–6 in which a 90° turn to the right is illustrated. The turn is begun by swinging sumping cylinder 46 outboard to a position such that when the cylinder is fully retracted, rear roof support jack 42 is closely adjacent the left wall (or rib) of the mine entry. In this position, rear roof support jack is actuated to engage the mine floor and roof and turning cylinder 64 is actuated to raise the right side of main frame 12. Sumping cylinder 46 then is extended (see FIG. 5) to push main frame 12 forward and to the right as it pivots around turning cylinder 64. Sumping cylinder 46 is retracted and the steps just described are repeated. In the present embodiment, mining machine 10 can be turned in one such step through an arc of about 25°. As sumping cylinder 46 is moved and repositioned, its associated roof bolter 62 may be operated to install roof bolts along the left rib of the mine entry as required.

By a series of four moves as indicated in FIG. 6, mining machine 10 can be moved from a position aligned with mine face 18 to a position aligned with the right mine rib. It is clear that when turning 90° in four moves, at least one of the moves will be less than the 25° maximum in the present embodiment. When mining machine 10 is aligned with the mine rib after being turned, the machine is operated in the manner described above to form a cross-cut to an adjacent parallel mine entry.

With respect to the mining operation itself, as augers 14 and 16 move across mine face 18 dislodging mineral, conveyor 20 on mining machine 10 is arranged to gather the dislodged mineral and transport it to the rear of the machine for further transport out of the mine. Conveyor 20 is a chain-type conveyor which uses a series of moving paddles (or flights) 27 to engage the dislodged mineral for transport along a stationary conveyor bed on main frame 12. Two separate endless chains are dressed around sprockets 24 and 25, respectively, which are driven through shaft 23 by hydraulic motor 22. The chains parallel one another along the length of leg 28, above and below the conveyor bed. The two chains diverge at the juncture of leg 28 with the cross member of main frame 12 and extend to the outer edges of that cross member where the chains are dressed around idler sprockets to reverse their direction. Flights 27 are connected to the chains at spaced intervals so that as the chains converge at the midpoint of the top surface of conveyor bed 100, flights 27 interlace in "zipper" fashion and move rearwardly along the bed portion of leg 28. Dislodged mineral from mine face 18 is thus moved along conveyor bed 100 from each end of the cross member of T-shaped main frame 12 and then rearwardly along the bed portion of leg 28. At the end of leg 28, the mineral is picked up on flexible belt conveyor system 80, which is well known in the art, for movement by that system to a loading or storage area and eventual removal from the mine.

Figure 9:
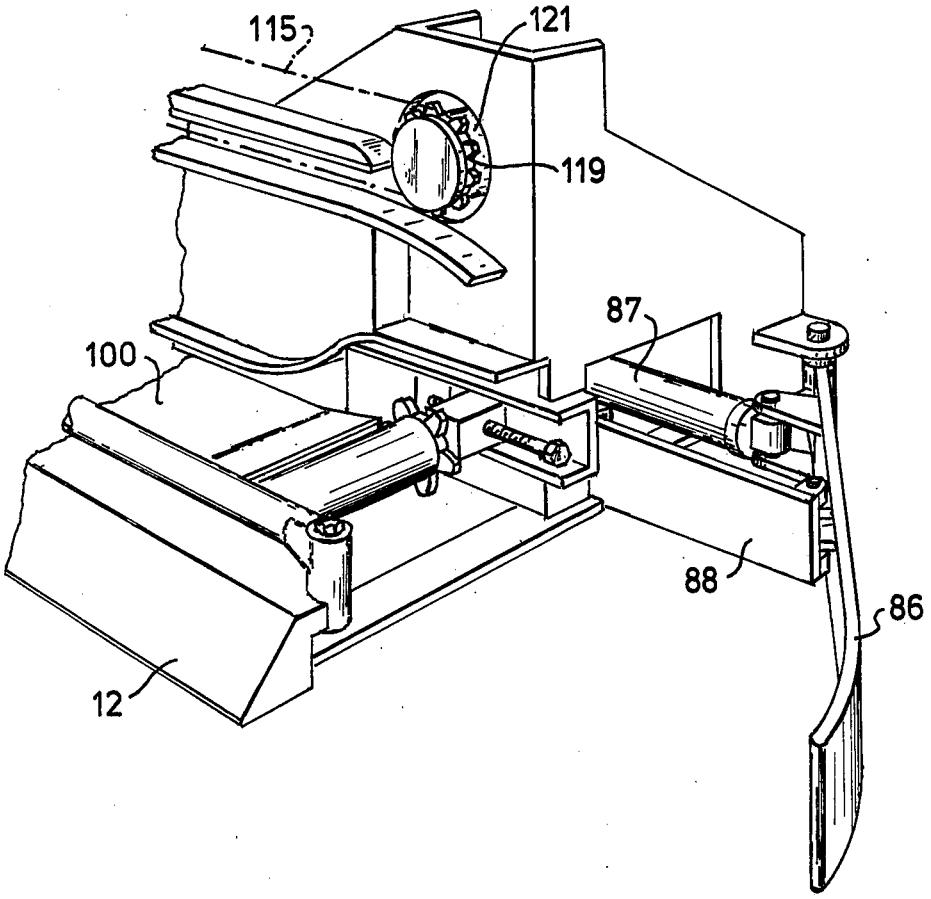
FIG. 9 is an enlarged perspective view of a portion of the machine shown in FIG. 1 showing a rib cleaner extended.

Rib cleaners 86 are supported at the outer ends of the cross member of T-shaped main frame 12. Rib cleaners 86 are movable outwardly by hydraulic cylinders 87 (see FIG. 9) for engagement with their adjacent mine rib. An air accumulator (not shown) may be used with hydraulic cylinders 87 to provide outward spring biasing forces on rib cleaners 86 to ensure their contact with the mine ribs. Rib cleaners 86 are adapted to scoop dislodged mineral from the mine floor adjacent the rib and force it onto conveyor bed 100. A plate 88, suitably mounted for movement with each rib cleaner, may be provided to assist in the forcing of dislodged mineral onto conveyor bed 100. In addition, a deflector (not shown), formed from wire mesh or the like, may be installed in front of hydraulic cylinder 87, spanning frame 12 and rib cleaner 86, to further aid in diverting dislodged mineral onto conveyor bed 100.

Augers 14 and 16, which themselves dislodge the mineral from mine face 18 by independent rotational movement effected by integral hydraulic motors 114 and 116, respectively, are of any well-known type and are used in the present invention in a manner more fully described in U.S. Pat. No. 3,827,754. The principal advantage of the auger arrangement is that it may be used in underground mines where the mineral seam height varies. Augers 14 and 16 are supported by independently movable arms 128 and 130, respectively, which in turn are pivotally mounted on carriage 110. Carriage 110 is mounted for reciprocal, sliding movement along the cross member of T-shaped frame 12 by means of a chain drive. This movement is effected by chain 115, the ends of which are connected to carriage 110. Chain 115 is dressed around sprocket 117 which is driven by hydraulic motor 113 and around idler sprocket 119 which is supported on main frame 12 by housing 121. Hydraulic cylinders 118 and 120 are connected between main frame 12 and arms 128 and 130, respectively, to effect individual up and down movement and positioning of augers 14 and 16, respectively. In the present embodiment, the augers are dimensioned to permit mining of mineral seams that vary in height from 30 inches and up.

Figure 7:
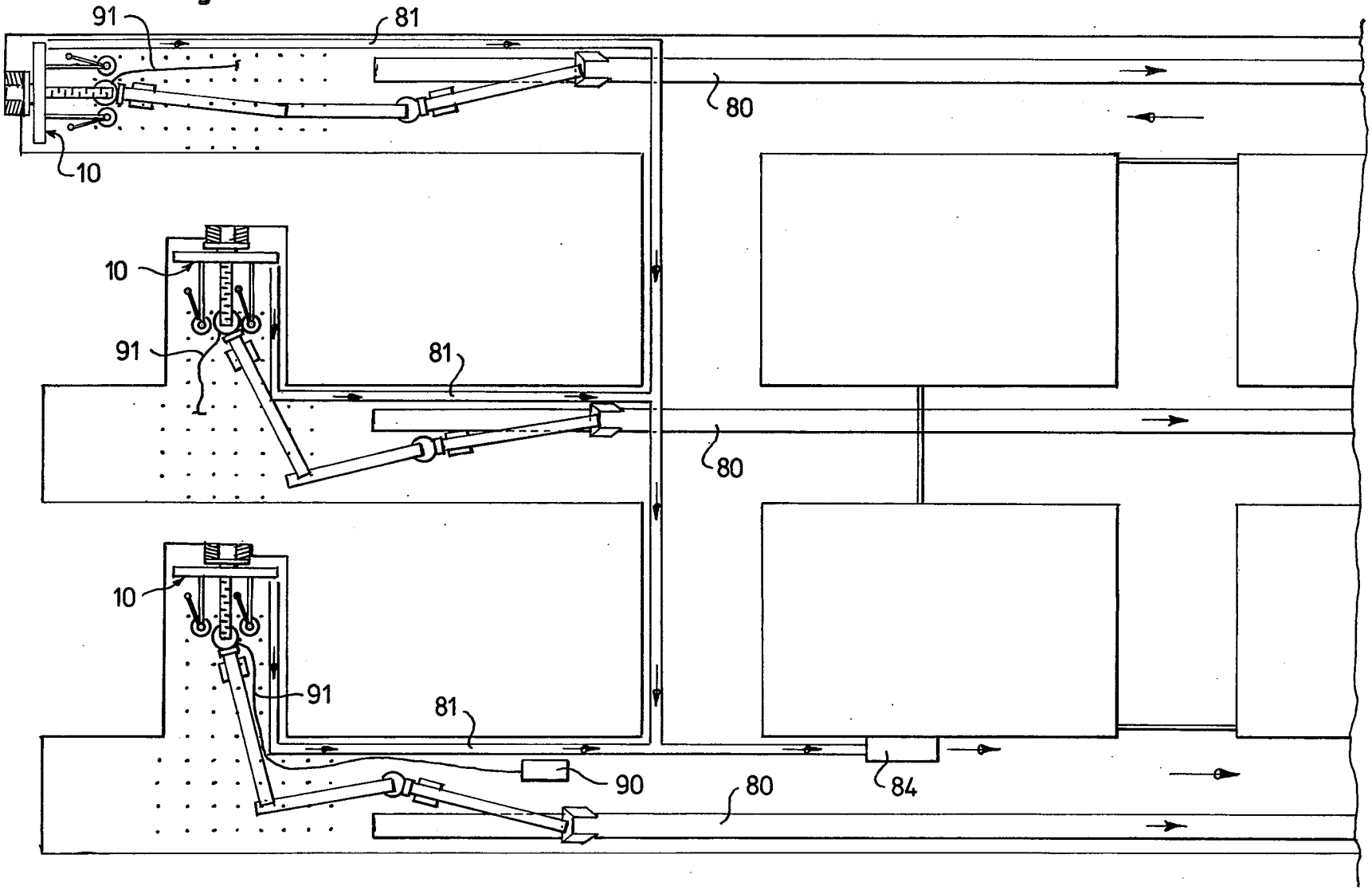
FIG. 7 is a schematic top plan view of an underground mine having three entries with one of the machines of the present invention in each entry; the view shows the formation of entries and cross-cuts, and the pattern of installed roof bolts.

The mining machine 10 of the present invention is advantageously used in multiple entry driving operations in which a machine is dedicated to each of the entries being driven. FIG. 7 illustrates such a use. It may be seen from that Figure that when a cross-cut is to be formed, the mining machine 10 in the parallel entry into which the cross-cut is to be driven can conveniently install the required row of roof bolts closely adjacent the mine rib at the point of breakthrough. This facility for so installing that row of roof bolts results from the structure of the present invention discussed above. When the mining machine 10 forming the cross-cut proceeds to drive toward the parallel entry, it need only progress far enough to install the required roof bolts in the cross-cut and need not progress completely into the adjacent entry. This technique, made possible by the use of multiple machines, reduces the congestion in the adjacent entry and thereby minimizes the risk of injury to mine personnel that so often attends congestion and equipment movement.

FIG. 7 also illustrates that when a cross-cut is to be formed, the mining machine 10 designated to form the cross-cut actually progresses in the entry beyond the centerline of the planned cross-cut. This permits the installation of roof bolts in the entry on a line approximately coinciding with a projection of the in-by rib of the cross-cut. After these roof bolts are installed, the mining machine 10 is moved backwardly until the transverse centerline of the machine is approximately aligned with the centerline of the proposed cross-cut. The machine 10 is then turned 90° by the procedure described above to place it in position to begin the cross-cut. Upon completion of the cross-cut, the machine is withdrawn from the cross-cut and is turned back toward the mine face 18 of its assigned entry. This turning operation and subsequent preparations to return to driving the entry all may be carried out under permanently supported roof by reasons of the procedures described above.

FIG. 7 also illustrates the practicality of operating three mining machines 10 from a single split of air. This advantage results from the fact that a mining machine is dedicated to each entry and, even though the machine may not dislodge mineral as rapidly as known mining machines, the machine of the present invention remains essentially at the mine face. This means that better dust control measures may be employed as in the use of flexible and extensible exhaust air ducts 81. These ducts 81 are operated in association with at least one exhaust fan 84. The ability to use flexible trailing conveyor systems 80 in each entry also simplifies the air flow pattern.

Mining machine 10 of the present embodiment is hydraulically powered from a trailing hydraulic package 90. Operators, who move with machine 10, operate the various hydraulic systems on machine 10 by means of suitable controls.

The machine 10 of the present embodiment is intended to form an entry that is 20 feet wide. The width of the cross member of the T-shaped frame is approximately 17 feet while the length of the machine from the tip of the augers to the end of leg 28 is less than 17 feet. Arms 128 and 130 permit their associated augers 14 and 16, respectively, to extend slightly beyond the outside edges of the main frame cross member during operation.

The entry driver of the present invention offers the advantage of a maneuverable, unitary piece of equipment capable of mining mineral, especially in low seam underground mines, while at the same time providing both temporary and permanent roof support as the machine progresses. The entry driver thus is able to remain at the mine face and need not be withdrawn with near the frequency of conventional mining machines which lack the flexibility of the present invention. This reduction in required movement of the entry driver contributes significantly to personnel safety within the mine.

In multi-entry mines, the machine of the present invention, partly because of its reduced cost compared with conventional machines, is ideally suited for application to each entry. The turning ability of the machine within an entry to permit the formation of cross-cuts between entries, coupled with the flexibility of the machine in installing the required roof bolts in and adjacent such cross-cuts, makes the present invention uniquely useful in multi-entry mine applications. Further, in such applications, the present invention permits better utilization of mine ventilation and dust control systems than has heretofore been possible.

What is claimed is:

1. A mining machine for forming an entry in an underground mine comprising:

a main frame having an elongated front portion and a rearwardly extending leg portion connected to said front portion intermediate of its ends;

a plurality of forward roof support jacks attached to said front portion of said main frame and each being operable between a retracted position and an extended position to provide temporary mine roof support;

a pair of sumping cylinders disposed on opposite sides of said leg portion of said main frame and connected at their forward ends to said front portion of said main frame by universal connections, said cylinders being independently operable between extended positions and retracted positions;

mine floor and roof engaging means pivotally connected to the rear ends of said sumping cylinders for detachably anchoring the rear ends of said sumping cylinders and for providing temporary mine roof support;

means connected between each of said sumping cylinders and said main frame for independently moving each said sumping cylinder about its universal connection thereto to position said sumping cylinder's associated mine floor and roof engaging means; and roof bolting means supported for movement about each of said mine floor and roof engaging means.

2. A mining machine as recited in claim 1 which further compriseds:

a pair of turning cylinders disposed on opposite sides of said leg portion of said main frame and vertically mounted in said elongated front portion thereof, each said turning cylinder being independently operable between an extended position in engagement with said mine floor and a retracted position out of engagement with said mine floor.

3. The mining machine recited in claim 2 wherein:

the length of said leg portion of said main frame is less than the length of said elongated front portion thereof.

4. The mining machine recited in claim 1 wherein:

said means connecting said sumping cylinders to said main frame each includes a hydraulic cylinder disposed therebetween having universal joint connections at each end.

5. A mining machine as recited in claim 1 which further comprises:

a conveyor extending across said elongated front portion of said main frame; and rib cleaner means extending outwardly from each end of said elongated front portion of said main frame to engage the adjacent mine rib and direct mined material onto said conveyor.

6. In a mining machine for use in forming underground mine entries having a T-shaped main frame with driven augers disposed to move back and forth along the head of the T-shaped main frame and a conveyor formed to carry coal from the head of the T-shaped main frame down the stem of the T-shaped main frame, a plurality of forward roof support chocks connected to the head of the T-shaped main frame, a plurality of rear roof support chocks disposed behind the forward roof support chocks, and advancing cylinders disposed between the head of the T-shaped main frame and the rear roof support chocks for moving the main frame forward relative to the rear roof support chocks, the improvement comprising:

universal connecting means for connecting the advancing cylinders to said T-shaped main frame to permit each of said plurality of rear roof support chocks to be moved independently in the arcuate path relative to its point of connection to the main frame;

a hydraulic cylinder connected between each advancing cylinder and said main frame for positioning the associated rear roof support chock at a desired position; and turning cylinders connected to the head of said T-shaped main frame, on either side of the stem, operable between a retracted position and an extended position partially supporting said main frame from the mine floor to permit the main frame to be pivoted therearound.

7. The improvement recited in claim 6 which further comprises:

a roof bolter connected to each rear roof support chock and being positionable therearound.

8. A mining machine for forming an entry in an underground mine comprising:

a main frame having an elongated front portion;

auger means disposed on the front of said main frame and being movable to dislodge mineral from the entry being formed;

conveyor means disposed on said main frame for transporting coal from the front of the mining machine;

a pair of forward roof support jacks connected to said main frame for movement therewith and being operable between a retracted position and an extended position to engage the mine roof for providing temporary roof support;

a pair of rear roof support jacks disposed behind said pair of forward roof support jacks and being operable between a retracted position and an extended position to engage the mine roof for providing temporary roof support;

a ram cylinder disposed between each rear roof support jack and said main frame and being movable between a retracted position and extended position for moving said main frame relative to the associated rear roof support jack;

a steering cylinder connected between said main frame and each of said ram cylinders for moving the associated ram cylinder about its connection to said main frame;

a pair of turning jacks connected to and spaced apart on the front portion of said main frame, each said turning jack being operable between an extended position, partially supporting said main frame from the mine floor, and a retracted position not supporting said main frame; and a roof bolter connected to each of said rear roof support jacks and being movable therearound for installing roof bolts which provide permanent roof support.

9. The mining machine recited in claim 8 wherein:

a pivot joint connects each said ram cylinder to its associated rear roof support jack; and a universal joint connects each said ram cylinder to said main frame.

10. The mining machine recited in claim 9 which further comprises:

rib cleaning means extending from each end of said elongated front portion of said main frame for engaging the mine rib.

11. The mining machine recited in claim 10 wherein said rib cleaning means comprises:

a scraper blade connected at one end to said main frame and having a free end extending toward the mine face;

a hydraulic cylinder for biasing said scraper blade into engagement with the mine rib; and an accumulator for maintaining said scraper blade in engagement with the mine rib.

12. A mine entry driver machine comprising:

a T-shaped main frame having the head of the T disposed toward the mine face;

cutter heads disposed to move back and forth across the head of said T-shaped main frame;

a plurality of forward roof support jacks disposed behind the head of said T-shaped main frame and connected thereto for unitary movement therewith;

a pair of rear roof support jacks connected behind said plurality of front roof support jacks and being disposed on opposite sides of the stem of said T-shaped main frame;

a pair of ram cylinders, one associated with each rear roof support jack, connected between the associated rear roof support jack and the head of said T-shaped main frame;

a roof bolter connected to each rear roof support jack for movement in a path therearound;

a steering jack connected between said main frame and each ram cylinder for positioning said rear roof support jack at a desired position; and conveyor means disposed to move material along the head and down the stem of said T-shaped main frame.

13. An entry driver as recited in claim 12 which further comprises:

a pair of turning cylinders, one located on each side of the stem of said T-shaped main frame, connected to the head of said T-shaped main frame and being movable between a retracted position and an extended position engaging the mine floor to provide a pivot point about which said T-shaped main frame can move.

14. An entry driver as claimed in claim 13 comprising:

rib cleaning means extending outwardly from each end of the head of said T-shaped main frame.

15. An entry driver as recited in claim 14 wherein:

the stem of said T-shaped main frame is shorter than the head of said T-shaped main frame.

16. An entry driver as recited in claim 15 wherein said rib cleaner means comprises:

a blade connected at one end to said main frame and having a free end extending toward the mine face;

a hydraulic cylinder for biasing said blade into engagement with the mine rib; and an accumulator for maintaining said blade in fairly constant pressure engagement with the mine rib.

* * * * *